US006263603B1

(12) United States Patent
Wildrick

(10) Patent No.: US 6,263,603 B1
(45) Date of Patent: Jul. 24, 2001

(54) LABEL HOLDER FOR FLAT FACED SHELVING

(75) Inventor: Richard J. Wildrick, Hunlock Creek, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 09/451,385

(22) Filed: Nov. 30, 1999

(51) Int. Cl.[7] ..... G09F 3/18
(52) U.S. Cl. ..... 40/661; 40/651
(58) Field of Search ..... 40/642.02, 649, 40/651, 661, 661.03, FOR 101

(56) References Cited

U.S. PATENT DOCUMENTS

| | | | |
|---|---|---|---|
| 4,295,288 | 10/1981 | Westberg | 40/651 X |
| 4,745,695 | 5/1988 | Hetzer | 40/661 |
| 5,044,104 | 9/1991 | Hopperdietzel | 40/649 X |
| 5,197,215 | 3/1993 | Torsleff | 40/649 X |
| 5,263,269 | 11/1993 | Tjarnlund . | |
| 5,473,833 | 12/1995 | Ostrovsky . | |
| 5,488,793 | 2/1996 | Gebka et al. | 40/649 X |
| 5,515,632 | 5/1996 | Gebka et al. | 40/649 |
| 5,899,011 | 5/1999 | Brinkman . | |
| 6,026,603 * | 2/2000 | Kump et al. | 40/661.03 |

FOREIGN PATENT DOCUMENTS

| | | | |
|---|---|---|---|
| 3346294 * | 6/1984 | (DE) | 40/651 |
| 3900904 * | 2/1990 | (DE) | 40/661 |
| 91/105324 * | 4/1991 | (WO) | 40/651 |

* cited by examiner

*Primary Examiner*—Brian K. Green
(74) *Attorney, Agent, or Firm*—Schweitzer Cornman Gross & Bondell LLP

(57) ABSTRACT

An extruded plastic label holder for placement on the flat front surface of a product display shelf. The label holder includes a clear front panel joined along its bottom edge with a second panel. The second panel is adhesively mounted on the shelf front surface, either directly or by means of a third panel flexibly joined with the second panel along upper edges of both. A short, rigid fulcrum rib is formed integrally with one of the second or (if employed) third panels, slightly above the bottom edge of the second panel and extending generally at right angles thereto. When the bottom edge of the label holder is pressed, the second panel flexes about the fulcrum rib, opening a gap at the upper portion of the label holder for placement or removal of paper labels. The use of a third panel helps to isolate the forces applied in flexing the second panel from the adhesive attachment, enabling less aggressive adhesives to be effectively utilized. Additionally, if a third panel is utilized, portions of the first and second panels can safely be allowed to project below the bottom of the shelf, to accommodate thin shelves or tall label holders, because the front and second panels can flex outwardly about the upper edge connection between the second and third panels. Where such downward projection is contemplated, it may be possible to eliminate the fulcrum rib and allow the bottom edge of the shelf to form the fulcrum.

12 Claims, 8 Drawing Sheets

LABEL HOLDER FOR FLAT FACED SHELVING

BACKGROUND OF THE INVENTION

The present invention relates to extruded plastic label holders of the general type having a clear front panel joined to a second panel along bottom edges of both and normally disposed such that the front panel is positioned close to or presses against the second panel in a manner to retain paper labels between them. In a well known form of such label holders, typically installed along the front edge of display shelving, a lower portion of the label holder projects below the mounting surface therefor, providing a fulcrum around which the label holder may be flexed rearwardly to separate the panels at the top for placement or removal of the labels.

For many applications where the display shelving has a flat front surface, it is either necessary or desireable to secure the label holder to the front edge of the shelf by adhesive, such as an adhesive strip applied between an upper edge margin of the label holder panel and an upper margin of the front surface of the shelf. In such cases, when label holders of conventional design are allowed to project below the bottom edge of the shelf, the bottom of the label holder may be snagged by product removal from lower shelves, which tends to dislodge the label holder. This problem can be dealt with by using aggressive adhesives, but such adhesives present a clean up problem later on and are best avoided.

SUMMARY OF THE INVENTION

In accordance with one aspect of the invention, a new and improved extruded plastic label holder is provided, which designed preferentially to be confined substantially within the vertical confines of the flat front surface of the shelving. To enable the label holder to be opened in a desired manner for placement and removal of labels, the label holder is provided with an integrally extruded fulcrum rib. The fulcrum rib extends generally at right angles to the panels of the label holder and displaces the lower portion of the label holder outward from the shelf front surface. This enables the label holder to be flexed about the fulcrum rib to open it for label manipulations.

In one of its basic forms the label holder of the invention is formed with two panels, a front panel and a second (back) panel, with the two panels being joined along their bottom edges. An adhesive strip, applied along an upper margin of the second panel, is utilized to mount the label holder to the flat front surface of a shelf. A short fulcrum rib is formed integrally with the second panel and extends toward the front surface of the shelf on which the label holder is mounted. The fulcrum rib is positioned a short distance above the lower edge of the label holder, and at a level to make contact with the shelf, and displaces the second panel a short distance in front of the front surface of the shelf. This enables the label holder to be flexed in the desired manner to accommodate label insertion and removal.

In a basic, two-panel configuration of the new label holder, flexing of the second panel about the fulcrum rib can stress the adhesive bond between the shelf front surface and the upper margin of the label holder. Accordingly, in a further preferred embodiment, the label holder includes a third panel flexibly connected at its top edge to the top edge of the second panel. In this embodiment, the label holder is adhesively bonded to the shelf by an adhesive strip mounted on the third panel. The fulcrum rib is integral with one of the second or third panels and extends between them to space the second panel away and enable it to be flexed for label manipulations.

An additional significant advantage of the three-panel embodiment is that, where the shelving is very narrow and/or it is desirable to use a label of considerable height, such that the bottom portion of the label holder will project below the bottom of the shelf, the label holder can be designed so that only the first and second panels project below the shelf. If these panels are accidentally snagged during product removal from the shelf below, the label holder can easily flex about the upper edge connection between the second and third panels.

In a further embodiment of the invention the panel at the back may be provided with a guide flange, extending rearwardly from the lower edge of the panel. The guide flange can be placed against the bottom of the shelf to facilitate accurate alignment of the label holder during the initial installation thereof.

For a more complete understanding of the above and other features and advantages of the invention, reference should be made to the following detailed description of preferred embodiments of the invention and to the accompanying drawings.

DESCRIPTION OF PREFERRED EMBODIMENTS OF THE INVENTION

Figure 1:
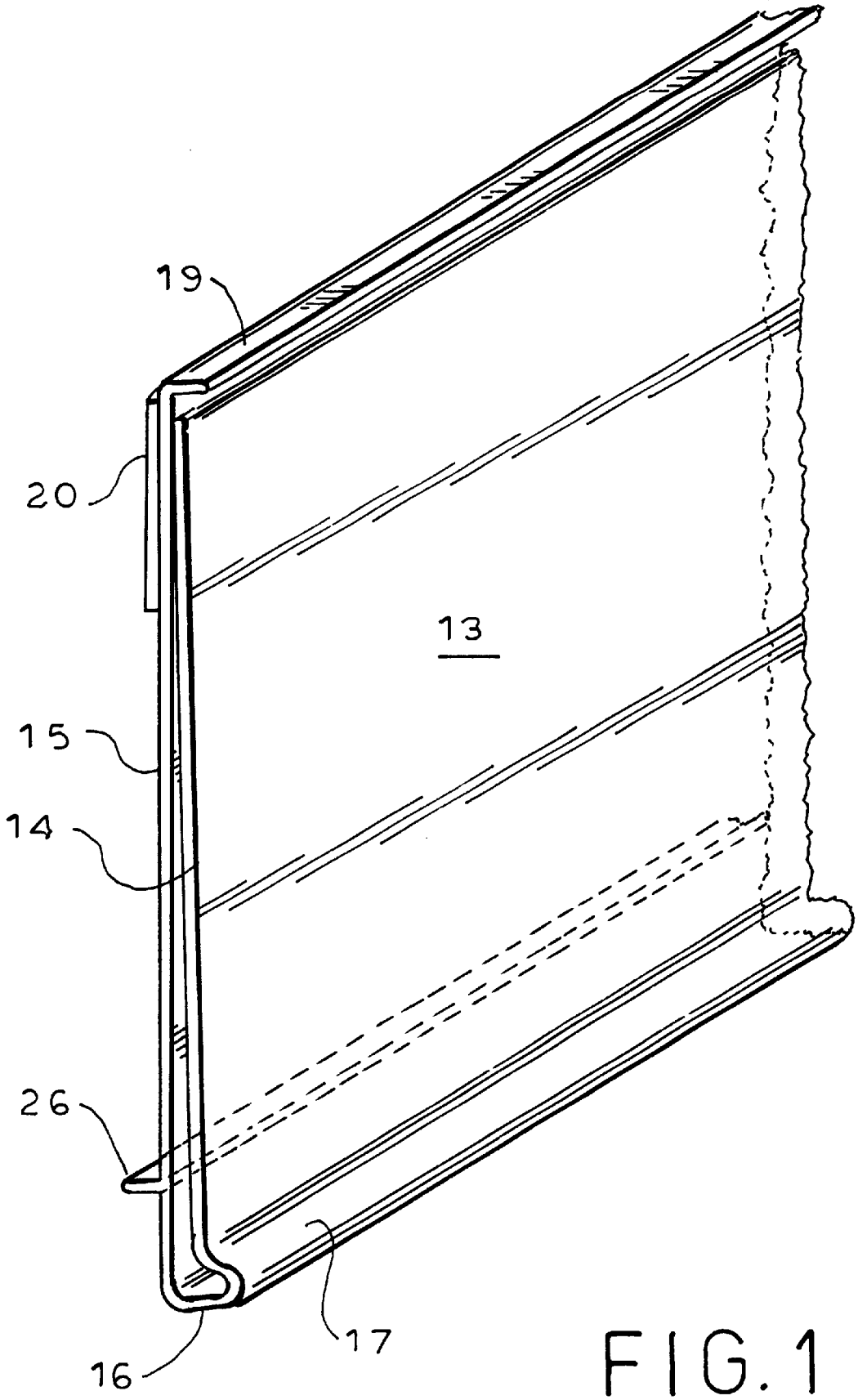
FIG. 1 is a fragmentary perspective view of a basic form of the label holder of the invention incorporating two panels.
Figure 2:
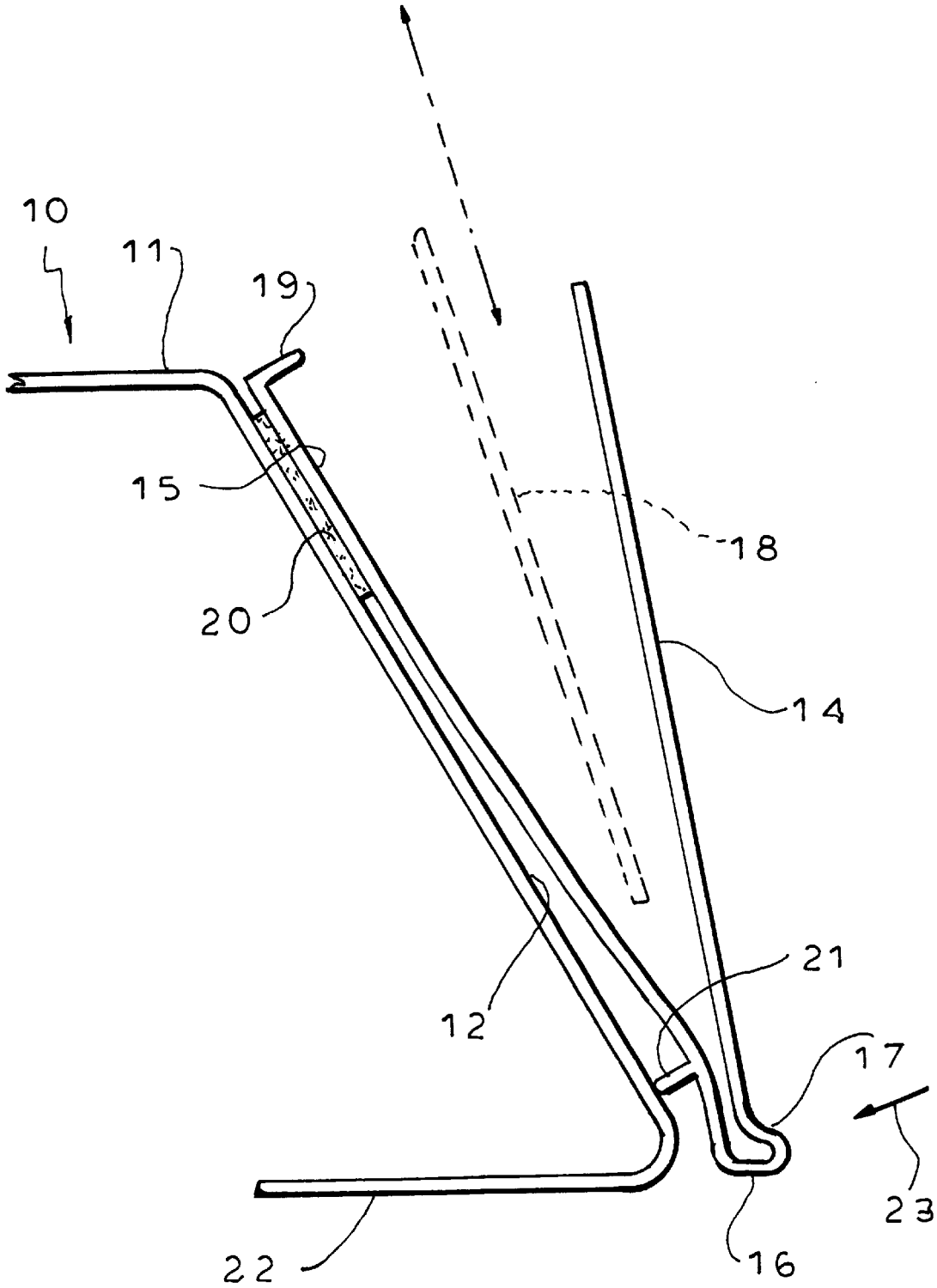
FIG. 2 is a side elevational view of the device of FIG. 1, shown in a flexed position for inserting or removing a label.

Referring now to the drawings, and initially to FIGS. 1 and 2 thereof, the reference numeral 10 designates generally a shelf structure having a top surface 11 and a flat, usually inclined front surface 12. Typically, the shelf 10 is part of a gondola structure (not shown) which is an independent structural unit of about four feet in length, with a plurality of shelves of such length placed at various vertical heights.

The label holder of FIGS. 1 and 2, designated generally by the numeral 13, is extruded of a suitable plastic material, such as polyvinyl chloride, in continuous lengths and typically cut to four foot lengths for installation on gondola shelves. The first illustrated embodiment comprises front and back panels 14, 15 joined at their bottom edges at 16. The lower edge of the front panel advantageously can be formed into a guide flange 17 to facilitate periodic scanning of the label information. The panels 14, 15 are quite thin (e.g. 0.025 inch) so as to be capable of being easily flexed. The front panel 14 is formed of clear plastic, while the back or second panel 15 may, and sometimes preferentially is, co-extruded of opaque material. As formed, the front and back panels 14, 15 normally are urged into contact or near contact at the top, providing a suitable cavity for receiving and retaining an information label 18. The top of the back panel 15 may be provided with a short protective flange 19, which projects forwardly over the top of the front panel 14 when the label holder is in its normal or closed position.

Preferentially, the height of the label holder 13 is no greater than the height of the front surface 12 of the shelf, such that the label holder does not project above the top or below the bottom of the shelf. In a typical embodiment, the height of the label holder may be about 1¼" to about 1 ½". A double-sided adhesive strip 20 is placed along the top portion of the back panel 15 for mounting the label holder to the shelf front surface 12. The adhesive strip, for a label holder of the size indicated, typically is a half inch or less in width so as to bond only the upper regions of the back panel 15 to the shelf.

Pursuant to one aspect of the invention, the back or second panel 15 of the label holder is formed with an integral, rearwardly projecting fulcrum rib 21. The fulcrum rib 21 projects substantially at right angles to the back panel and is located a short distance, for example ⅛" 3⁄16", above the bottom edge of the label holder. The fulcrum rib projects a short distance to the rear of the panel 15, for example a distance of sixteenth inch or so.

As shown in FIG. 2, the height of the label holder 13 is approximately the same as that of the front surface 12 of the display shelf 10, such that the label holder does not project significantly above the top surface 11 of the shelf or below the bottom surface 22 thereof.

When the label holder 13 is suitably mounted on the display shelf, as shown in FIG. 2, it may be opened for label placement and removal by pressing rearwardly against the bottom edge 16 of the label holder, as indicated by the arrow 23 in FIG. 2. This causes the back panel 15 of the label holder to be flexed about the fulcrum rib 21, displacing the front panel 14 to an open position. As soon as the pressure is released, the label holder returns to its normal, closed position, as reflected in FIG. 1.

The fulcrum rib 21 assures that there will be sufficient space behind the back panel 15 to accommodate rearward displacement of the lower edge thereof to enable the label holder to be opened, without requiring the lower portion of the label holder to project below the bottom of the shelf. The fulcrum rib 21 is so constructed, in relation to its projected length, as to be effectively rigid in resisting the rearward pressure applied to the lower edge of the label holder.

Figure 3:
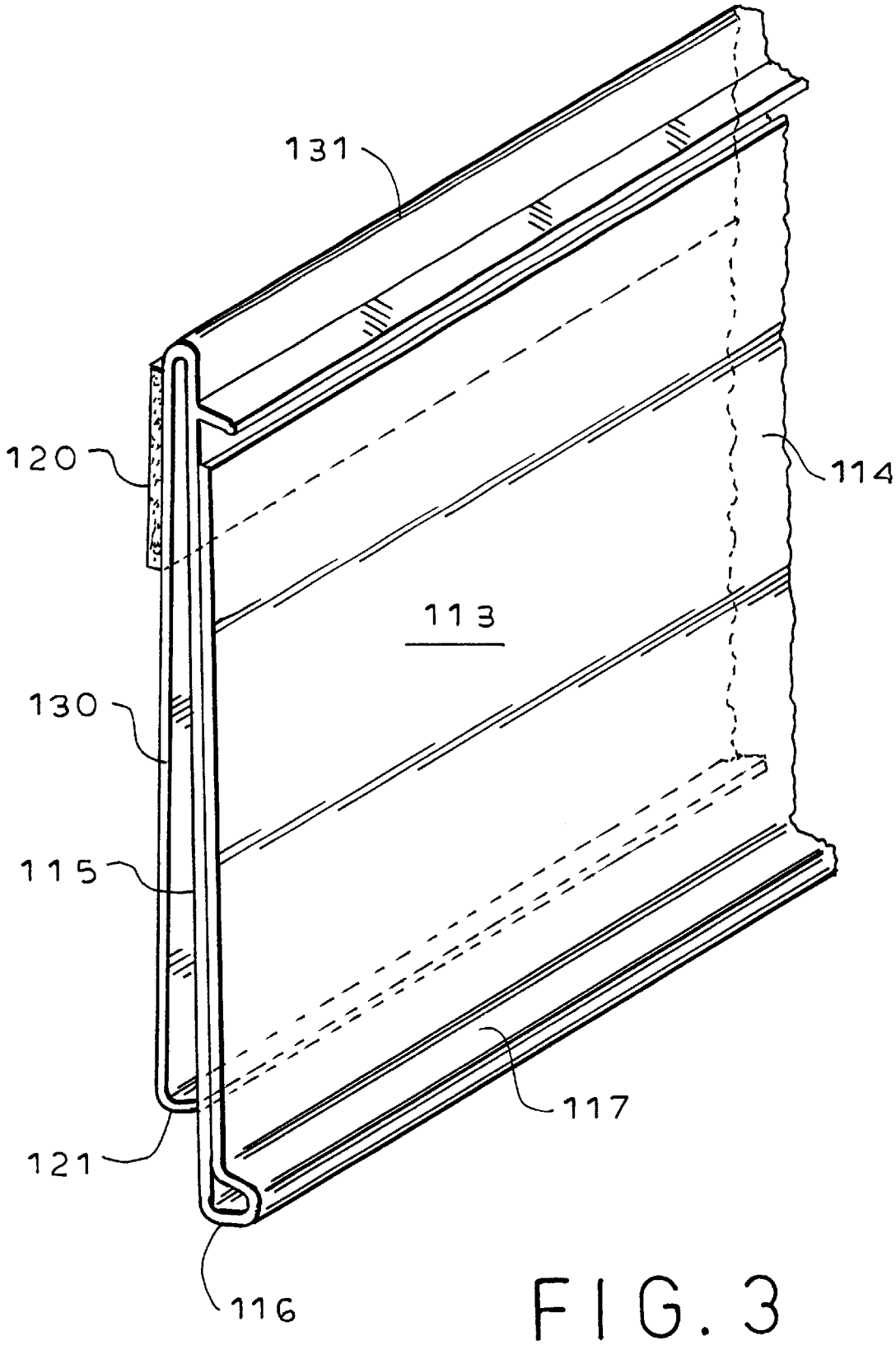
FIG. 3 is a perspective view of a second embodiment of the invention incorporating three panels.
Figure 4:
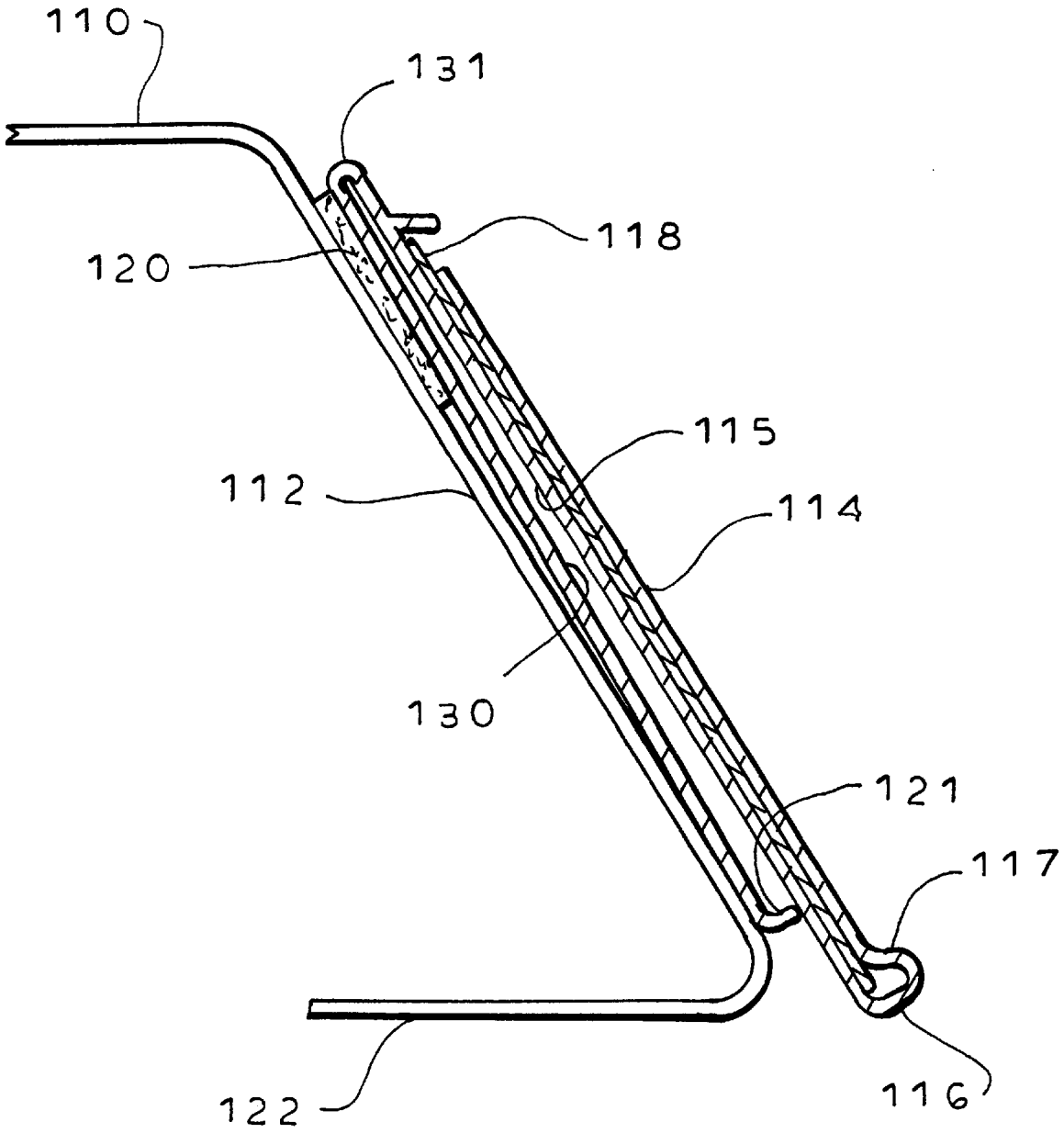
FIG. 4 is a side elevational view, partly in cross section, of the label holder of FIG. 3.
Figure 5:
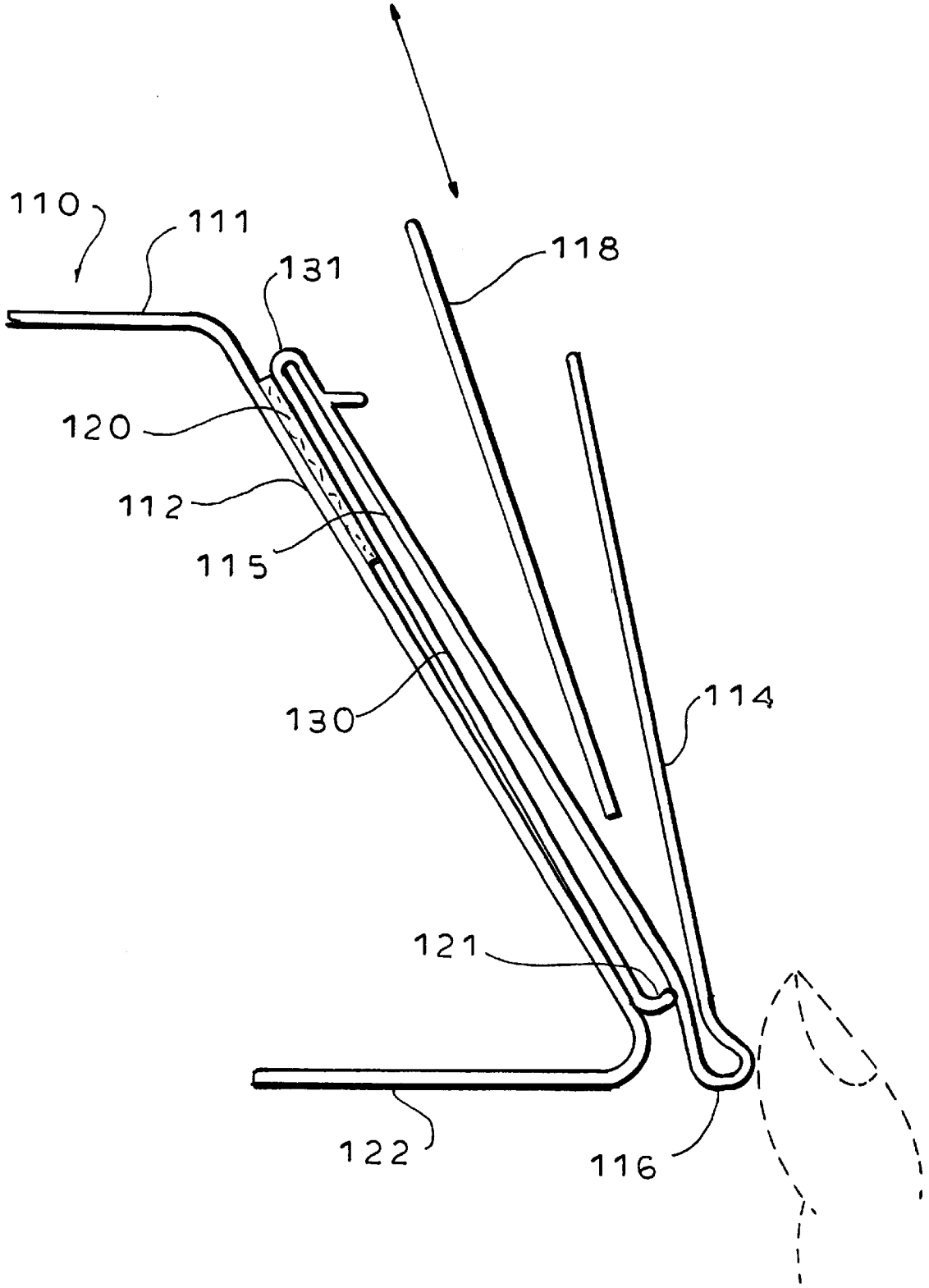
FIG. 5 is a side elevational view of the label holder of FIG. 3, shown in a flexed position for inserting or removing a label.

In the embodiment of FIGS. 3–5, the label holder 113 of the invention is preferentially formed with three panels. A front panel 114, formed of clear plastic, is joined along a bottom edge 116 thereof to a back panel 115. The design and construction of this part of the embodiment of FIGS. 3–5 corresponds in general with that of the embodiment of FIGS. 1–2. In the embodiment of FIGS. 3–5, however, a third panel 130 is provided, which integrally joins with the second panel 115 at the top edge region 131 of both panels. In the case of the second embodiment, the panel 130 constitutes the back panel, and an adhesive strip 120 is provided on the back panel for securing it to the flat front face 112 of a display shelf 110.

In the embodiment of FIGS. 3–5, a fulcrum rib 121 may be formed integrally with either the second panel 115 or the back panel 130. However, preferentially it is formed as a bottom edge flange of the back panel 130. As in the case of the embodiment of FIGS. 1 and 2, the fulcrum rib 21 is positioned a short distance above the bottom edge 116 of the front and second panels, and also to lie within the confines of the front surface 112 of the display shelf. Accordingly, when manual pressure is applied to the bottom edge of the label holder, as indicated in FIG. 5, the second panel 115 is flexed about the fulcrum rib 121, causing the front panel 114 to be opened in the desired manner.

An advantage of the FIG. 3–5 embodiment is that, when the second panel 115 is flexed in the manner shown in FIG. 5, it flexes against the upper edge area 131 where it is attached to the third panel 130. The adhesive strip 120 is thus substantially isolated from stresses involved in the flexing of the second panel 115. In this respect, in the embodiment of FIGS. 1–2, it is important that the adhesive strip be confined to upper marginal portions of the second panel 15, to allow the lower portions of that panel to flex during opening of the label holder. In the embodiment of FIGS. 3–5, the flexing movements of the second panel 115 are effectively isolated from the adhesive strip. Accordingly, if desired, the adhesive strip may be of greater width. However, there is no particular benefit to making the adhesive strip any wider than is necessary for secure mounting of the label holder.

Figure 6:
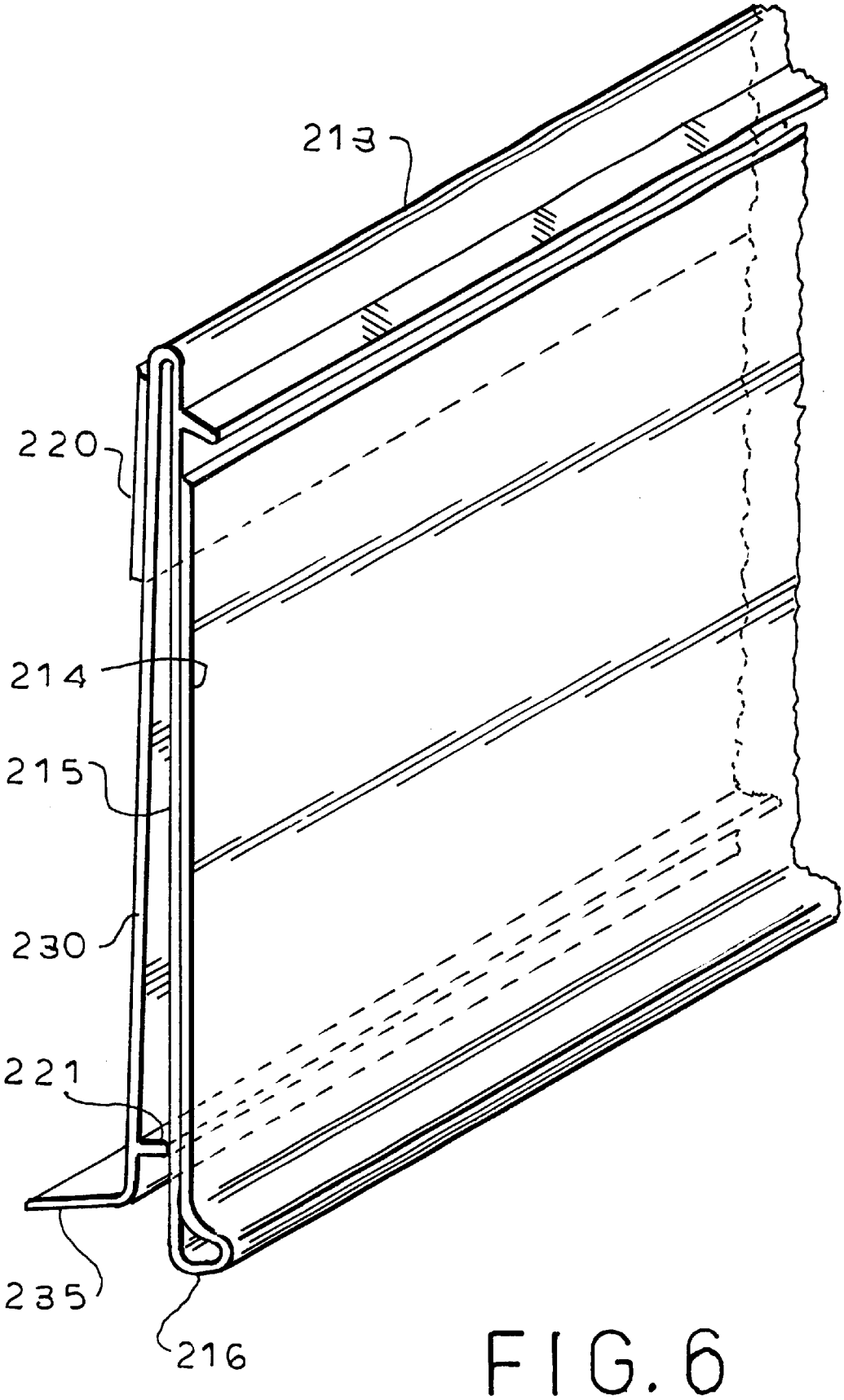
FIG. 6 is a perspective view of a modification of the label holder of FIG. 3, provided with a guide flange.
Figure 7:
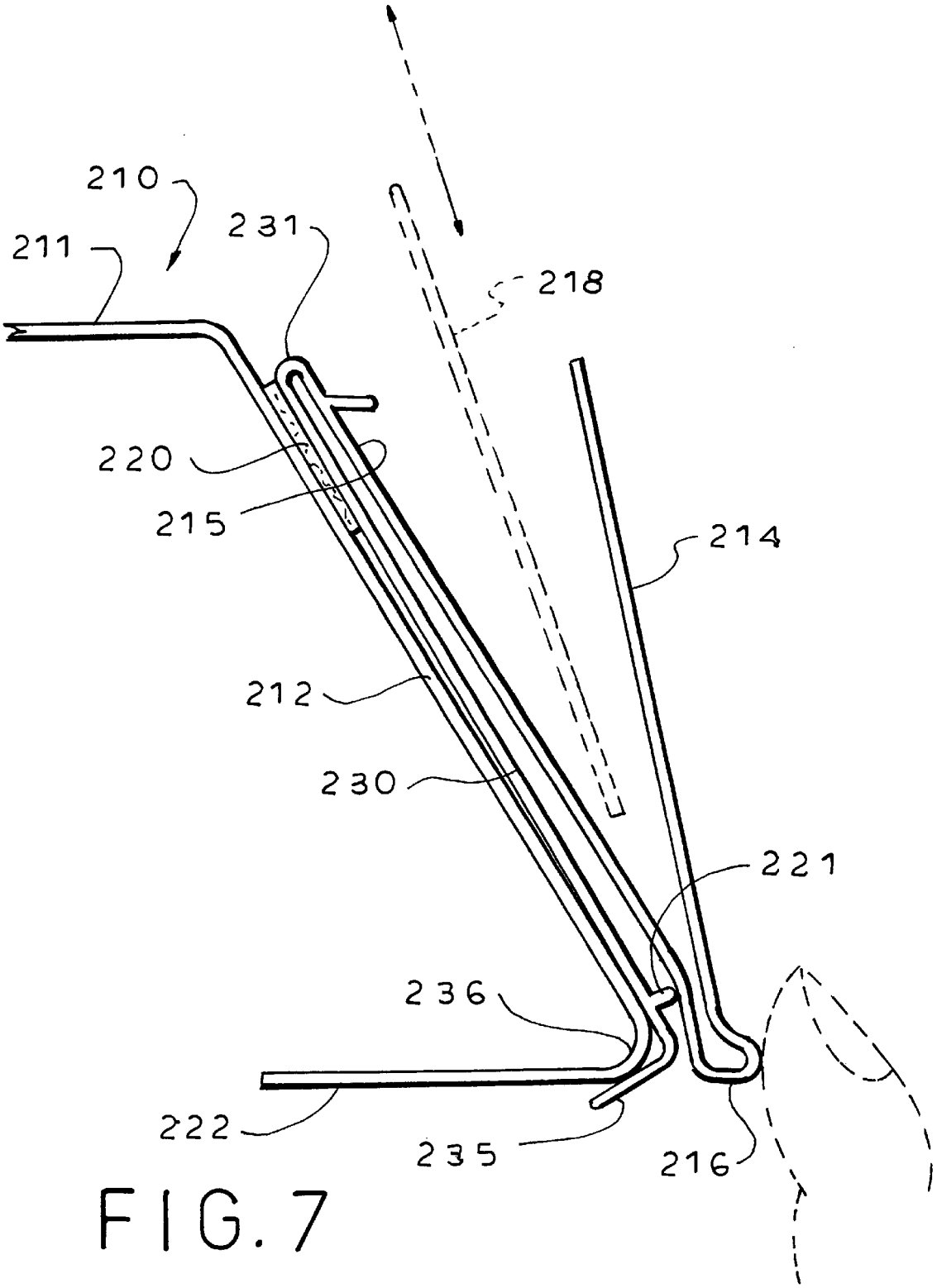
FIG. 7 is a side elevational view of the embodiment of FIG. 6, shown in an installed position on a shelf.

To facilitate quick and accurate mounting of the label holder onto the display shelving, it is advantageous to provide the back panel with a guide flange, in the manner shown in FIGS. 6 and 7. In the embodiment of FIGS. 6–7, a three panel label holder is illustrated, which in most respects corresponds with the embodiment of FIGS. 3–5. In the embodiment of FIGS. 6–7, however, the back panel 230 is extended a short distance below the fulcrum rib 221 and is provided with a rearwardly projecting flange 235 at its bottom extremity.

In order to install the label holder of FIGS. 6 and 7, the label holder is tilted upward slightly toward a vertical position, and moved upward and against the front surface 212 of the display shelf 210. The label holder is slid in an upward direction, while keeping the adhesive strip 220 out of contact with the shelf surface, until the positioning flange 235 engages the lower front corner area 236 of the shelving. When the positioning flange 235 engages the shelf along the full length of the label holder, it can be tilted rearwardly to bring the adhesive strip 220 into contact and fix the label holder in a desired position.

In some instances, it may be desirable to allow some portion of the label holder to project below the bottom of the display shelf, as where the display shelf is relatively thin and/or where it is desired that a relatively tall information label be accommodated by the label holder. For such circumstances, a modified version of the configuration of the three-panel embodiments of FIGS. 3–5 and/or 6–7 can be employed to advantage. Such a modification is illustrated in FIG. 8.

Figure 8:
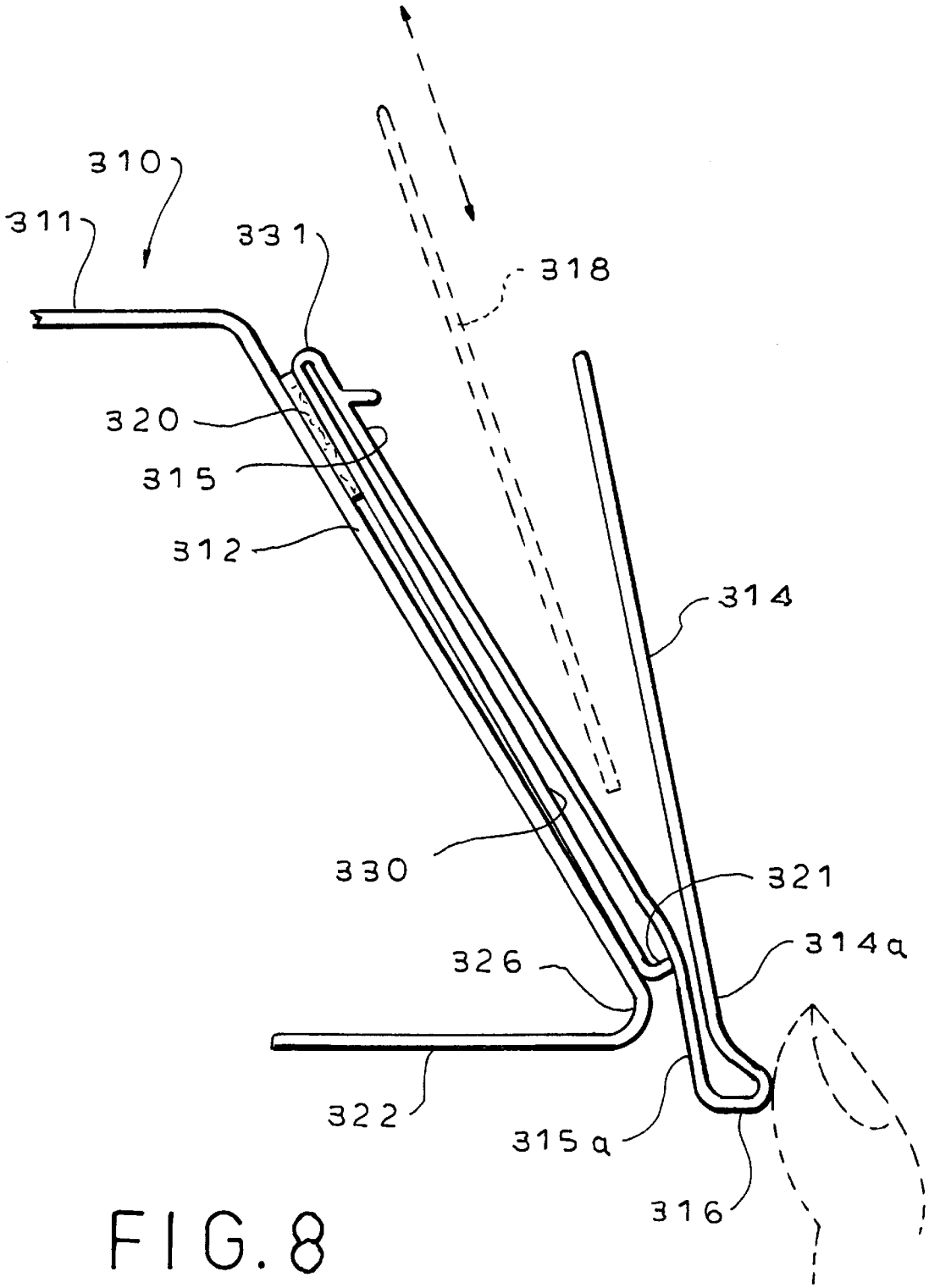
FIG. 8 is a side elevational view, similar to FIG. 7, of yet another embodiment of the invention designed to accommodate projection of the label holder below the bottom of the display shelf.

In the embodiment of FIG. 8, a three-panel label holder comprises a front panel 314, a second panel 315 joined to the front panel in the bottom edge region 13, and a back panel 330 joined to the second panel 315 along their respective top edges at 331. As in the case of the embodiment of FIGS. 3–5, the back panel 320 is provided at its lower extremity with a forwardly projecting fulcrum rib 321 positioned to lie within the confines of the front surface 312 of the shelf. In the embodiment of FIG. 8, the lower portions 314*a* and 315*a* of the respective front and second panels are extended, as necessary or appropriate, to a level below the bottom wall 322 of the display shelf. In such a circumstance, although the downwardly projecting portion of the label holder might be snagged and temporarily displaced during product removal from the shelf below, the entire assembly of the front panel 314 and second panel 315 is able to resiliently flex outwardly at the upper edge joint 331 between the second and back panels 315, 330. The flexibility of the material is such that there is little resistance to outward movement of the panels 314, 315, so that the product removal occurs relatively uneventfully, and there is little stress applied to the adhesive strip 320.

In the three panel version of the invention, in which a downward projection 314*a*, 315*a* is provided as in FIG. 8, if the downward projection is sufficient, it may be acceptable to omit the fulcrum rib 321 and allow the lower edge 326 of the shelving to serve as a fulcrum for opening purposes. Although such an arrangement in a label holder of conventional construction has important disadvantages, in a three panel construction, where the front and second panels may be resiliently displaced outwardly by pivoting around the upper edge connection 331, many of these disadvantages are obviated.

In any of its various forms, the label holder of the invention represents a significant improvement over known label holders used for the same purpose. In its principal forms, the label holder construction of the invention enables the entire label holder to be confined within the top-to-bottom limits of the flat front face of the display shelf, while providing for the necessary opening and closing manipulations of the label holder through the provision of a short fulcrum rib near the lower edge of the label holder.

The three-panel version of the invention, although utilizing additional material, provides a particularly high quality installation, in which the flexing of the label holder as required for inserting and removing labels, is effectively isolated from the adhesive strip by which the label holder is mounted to the shelving. This has the advantage of allowing less aggressive adhesive formulations to be utilized, so that adhesive removal and clean up, during replacement of the label holders, is much more easily accomplished. Additionally, the three panel configuration of the invention enables the front and second panels of the label holder to project downward below the bottom of the shelf on which the label holder is mounted, if necessary, without suffering the disadvantages inherent in label holders of known design.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A combination of a label-holding strip and a display shelf, where the display shelf has a generally flat front surface of predetermined top-to-bottom dimension, said label-holding strip comprising:

(a) an elongated extruded length of flexible plastic material forming a clear front panel and a second panel behind said front panel, a bottom edge portion of said front panel being connected to a bottom edge portion of said second panel, (b) said second panel being formed of resiliently flexible material capable of flexing in lower portions thereof to enable a label-receiving/removing opening to be formed at the top of said label-holding strip, (c) an elongated strip of adhesive material of less width than said top-to-bottom dimension mounted on said label-holding strip for securing said label-holding strip to said front surface, (d) a fulcrum rib, forming an integral part of said elongated extruded length, extending parallel to said bottom edge portions at a level adjacent to but above a lower edge of said flat front surface and substantially closer to said bottom edge portion of said second panel than to a top edge portion of said second panel, (e) said fulcrum rib being oriented substantially at right angles to said flat front surface and to said second panel and serving to displace lower portions of said second panel away from said flat front surface, (f) said second panel being adapted to be flexed to a forwardly convex contour about said fulcrum rib upon application of rearward pressure to lower extremities of said front panel, to form said label-receiving/removing opening between upper portions of said front and second panels, (g) said fulcrum being of such thickness in relation to its width as to be effectively rigid in a direction at right angles to said flat front surface, to resist said rearward pressure during flexing of said second panel.

2. The combination of claim 1, wherein (a) said fulcrum rib is integral with said second panel and extends from said second panel toward said flat front surface.

3. The combination of claim 2, wherein (a) said strip of adhesive is of substantially less width than the top-to-bottom dimension of said front edge surface and adhesively bonds an upper margin of said second panel to an upper margin of said front surface, and (b) the bottom edge portions of said panels are positioned at a level not substantially below the lower edge of said flat front surface.

4. The combination of claim 1, wherein (a) said label-holding strip including a third panel having upper and lower edges and having its upper edge integrally joined with an upper edge of said second panel to form a flexible connection, (b) said elongated strip of adhesive joining said third panel to said flat front surface, and (c) said fulcrum rib extending between lower portions of said second and third panels.

5. The combination of claim 4, wherein (a) lower edge portions of said front and second panels being dimensioned to extend below the lower edge of said flat front surface.

6. The combination of claim 4, wherein (a) said fulcrum rib is integral with said third panel and extends toward said second panel, generally at right angles to said second and third panels.

7. The combination of claim 6, wherein (a) said fulcrum rib is formed at a lower edge extremity of said third panel.

8. The combination of claim 6, wherein (a) said third panel has a lower edge portion projecting below said fulcrum rib, (b) said third panel further having a guide flange projecting rearwardly from a lower end extremity thereof for aligning engagement with the lower edge of said flat front surface.

9. The combination of claim 4, wherein (a) said elongated strip of adhesive is of substantially less width than said top-to-bottom dimension and serves to bond upper portions of said third panel to upper portions of said flat front surface.

10. The combination of claim 1, wherein (a) said panels have a width of between 1.25 and 1.5 inches, and (b) said fulcrum rib is positioned approximately 3/16" above lower edge extremities of said panels.

11. The combination of claim 10, wherein (a) said elongated strip of adhesive has a width of approximately ½ inch.

12. A combination of a label-holding strip and a display shelf, where the display shelf has a generally flat front surface of predetermined top-to-bottom dimension, said label-holding strip comprising:

(a) an elongated extruded length of plastic material forming a clear front panel and a second panel behind said front panels, a bottom edge portion of said front panel being connected to a bottom edge portion of said second panel, (b) said second panel being formed of resiliently flexible material capable of flexing in lower portions thereof to enable a label-receiving/removing opening to be formed at the top of said label-holding strip, (c) said second panel being adapted to be flexed to a forwardly convex contour upon application of rearward pressure to lower extremities of said front panel, to form said label-receiving/removing opening between upper portions of said front and second panels, (d) a third panel extruded integrally with said second panel and having an upper edge connected to said second panel along an upper edge of said second panel, (e) an elongated strip of adhesive material on said third panel for securing said third panel to the front surface of said shelf, (f) said front panel and second panel having bottom edge portions extending substantially below lower edge extremities of said third panel whereby, when said label-holding strip is mounted on said front surface, portions of said front and second panels project below the bottom of said front surface, (g) a fulcrum rib, forming an integral part of one of said second or third panels, extends parallel to said bottom edge portions at a level adjacent to a lower edge of said flat front surface and substantially closer to said bottom edge portion of said second panel than to top edge portion of said second panel, (h) said fulcrum rib being oriented substantially at right angles to said flat front surface and to said second panel and serving to displace lower portions of said second panel away from said flat front surface, (i) said fulcrum rib providing an edge about which flexing of said second panel may occur during opening of said label-holding strip for insertion and removal of a label.

* * * * *